US007401781B2

(12) United States Patent
Guyer et al.

(10) Patent No.: US 7,401,781 B2
(45) Date of Patent: Jul. 22, 2008

(54) METHOD FOR PLAYING A GAME

(75) Inventors: Reynolds W. Guyer, Mendota Heights, MN (US); Thomas W. Guyer, Minneapolis, MN (US)

(73) Assignee: Winsor Concepts, St. Paul, MN (US)

( * ) Notice: Subject to any disclaimer, the term of this patent is extended or adjusted under 35 U.S.C. 154(b) by 0 days.

(21) Appl. No.: 10/928,459

(22) Filed: Aug. 27, 2004

(65) Prior Publication Data

US 2005/0046107 A1 Mar. 3, 2005

Related U.S. Application Data

(60) Provisional application No. 60/498,130, filed on Aug. 27, 2003.

(51) Int. Cl.
*A63F 9/04* (2006.01)

(52) U.S. Cl. ..... 273/146

(58) Field of Classification Search ..... 273/146, 273/268, 274

See application file for complete search history.

(56) References Cited

U.S. PATENT DOCUMENTS

| | | | | |
|---|---|---|---|---|
| 817,233 A * | 4/1906 | Emmerling | ..... | 273/260 |
| 882,945 A | 3/1908 | Hurst | | |
| 1,584,316 A | 5/1926 | Mayhew | | |
| 2,044,122 A | 6/1936 | Michener | ..... | 273/134 |
| 3,608,902 A * | 9/1971 | Weisbecker | ..... | 273/248 |
| 3,642,286 A * | 2/1972 | Moore | ..... | 273/243 |
| 3,747,935 A | 7/1973 | Engelbrecht | ..... | 273/138 |
| 3,929,337 A * | 12/1975 | Hayes | ..... | 273/243 |

(Continued)

FOREIGN PATENT DOCUMENTS

FR 1432719 6/1966

OTHER PUBLICATIONS

Bunco Rules, The Rules of Bunco website www.buncorules.com/rules.html (5 pages; printed Aug. 2, 2004).

(Continued)

*Primary Examiner*—Eugene Kim
*Assistant Examiner*—Dolores R. Collins
(74) *Attorney, Agent, or Firm*—Westman, Champlin & Kelly, P.A.

(57) ABSTRACT

The present invention relates to a method of playing a game of chance and entertainment, which incorporates an element of risk by rewarding a player for corresponding master and score value designations. One embodiment of the method of the present invention is played by at least one player. This embodiment is played with one master die and a plurality of scoring dice. The master die has a plurality of master sides, each master side bearing a master value designation thereon. Each scoring die has a plurality of scoring sides, with each scoring side of each scoring die bearing a score value designation corresponding to one of the master value designations. In a turn, the player shakes the master die and the plurality of scoring dice to obtain an upwardly facing master side and a plurality of upwardly facing scoring sides. The player's shake score is then calculated based on the number of upwardly facing scoring sides with score value designations which correspond to the master value designation on the upwardly facing master side.

25 Claims, 8 Drawing Sheets

U.S. PATENT DOCUMENTS

| | | | | | |
|---|---|---|---|---|---|
| 4,469,329 | A | * | 9/1984 | Guyer | 273/146 |
| 4,648,602 | A | | 3/1987 | Maroney | 273/146 |
| 4,834,386 | A | * | 5/1989 | Rosenthal et al. | 273/146 |
| 4,930,780 | A | * | 6/1990 | Goodman et al. | 273/146 |
| 4,961,581 | A | * | 10/1990 | Barnes et al. | 273/236 |
| 5,080,370 | A | | 1/1992 | Lu | 273/260 |
| 5,114,147 | A | * | 5/1992 | Faylo | 273/146 |
| 5,364,101 | A | * | 11/1994 | Spooner et al. | 273/146 |
| 5,405,145 | A | * | 4/1995 | Jones et al. | 273/146 |
| 5,649,704 | A | | 7/1997 | Dobbin | 273/268 |
| 6,120,377 | A | * | 9/2000 | McGinnis et al. | 463/20 |
| 6,299,166 | B1 | | 10/2001 | Factor | 273/146 |
| 6,746,328 | B2 | * | 6/2004 | Cannon et al. | 463/17 |

OTHER PUBLICATIONS

Supplemental EPO Search Report for PCT/US2004028140 dated Aug. 27, 2007 from the European Patent Office, 4 pages.
Bunco Rules, The Rules of Bunco, 5 pages, Aug. 2, 2004.

* cited by examiner

METHOD FOR PLAYING A GAME

CROSS-REFERENCE TO RELATED APPLICATION(S)

Priority is claimed under U.S. Provisional Patent Application Ser. No. 60/498,130 filed on Aug. 27, 2003, entitled "Streek Dice Game" by Reynolds W. Guyer and Thomas W. Guyer, which is incorporated by reference.

BACKGROUND OF THE INVENTION

The present invention relates generally to a method for playing a game of chance and entertainment. More specifically, to a game that uses a relationship between a master indicator and several scoring indicators to determine a player's score.

Games of chance and entertainment exist in a variety of forms. The gambling industry, namely casinos, offers players several gaming options. These options however, are often elaborate games involving complex rules and requiring special tables or machines. Players therefore are unable to reenact the excitement in private without sufficient expense.

There also exists several games for a player to play in private, either alone or with other players. These games however, are often exceedingly simple and do not offer the player a significant level of risk or excitement. Therefore these games are unable to consistently offer the player a desired level of entertainment.

BRIEF SUMMARY OF THE INVENTION

The present invention relates to a method of playing a game of chance and entertainment. The method of the present invention incorporates an element of risk by rewarding a player when, during a turn, a generated master indicator corresponds to a plurality of scoring indicators.

One embodiment of the method of the present invention is played (by at least one player) with one master die and a plurality of scoring dice. The master die has a plurality of master sides, each master side bearing a master value designation thereon. Each scoring die has a plurality of scoring sides. Each scoring side of each scoring die bears a score value designation corresponding to one of the master value designations. In a turn, the player shakes the master die and the plurality of scoring dice to obtain an upwardly facing master side and a plurality of upwardly facing scoring sides. The player's shake score is then calculated based on the number of upwardly facing scoring sides with score value designations which correspond to the master value designation on the upwardly facing master side.

A second embodiment of the method of the present invention is played (by at least one player) with one master indicator and a plurality of scoring indicators. The master indicator has a plurality of possible master value designations. Each scoring indicator has a plurality of possible score value designations. Each score value designation corresponds to one of the master value designations. The player's turn comprises generating one of the master value designations of the master indicator and generating a score value designation for each of the scoring indicators. After the turn, the player's score is obtained based on the number of score value designations generated, which correspond to the master value designation generated.

While the above-identified drawing figures set forth several embodiments of the invention, other embodiments are also contemplated, as noted in the discussion. In all cases, this disclosure presents the present invention by way of representation and not limitation. It should be understood that numerous other modifications and embodiments can be devised by those skilled in the art which fall within the scope and spirit of the principles of this invention.

DETAILED DESCRIPTION

Figure 1:
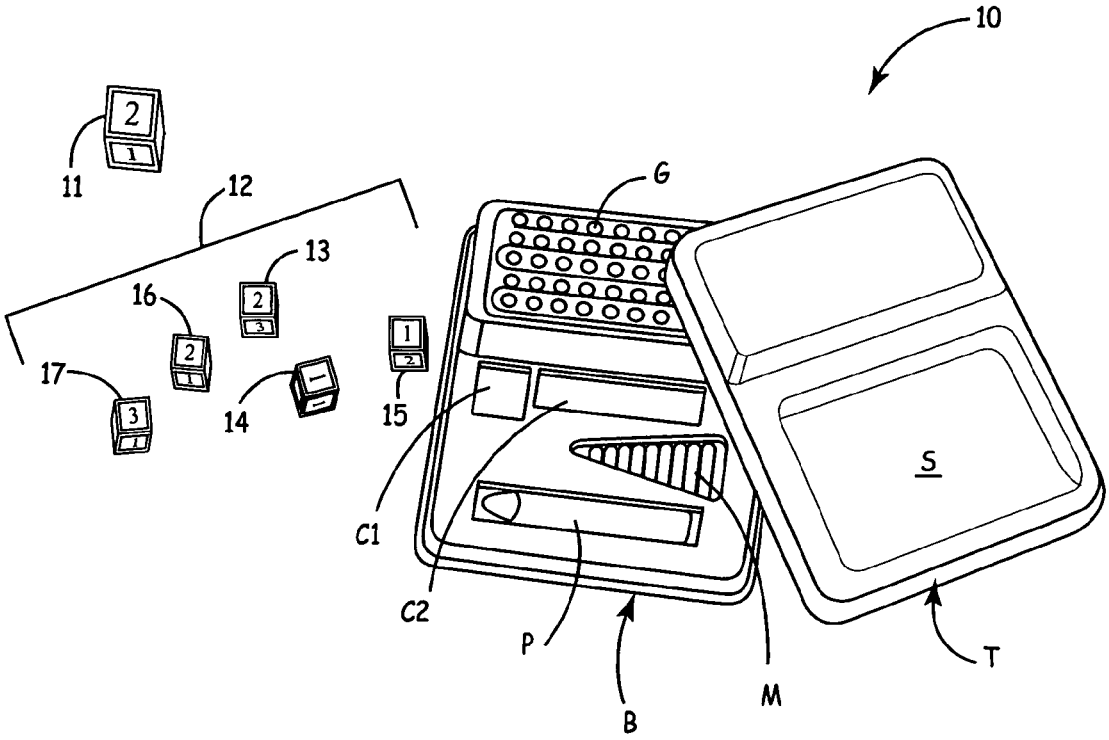
FIG. 1 is a perspective view of a first embodiment of a kit for use in playing a game of the present invention.

FIG. 1 is a perspective view of a kit of playing pieces 10 for playing a game of the present invention. The pieces used in one embodiment of a game of the present invention comprise one master die 11 and a plurality of scoring dice 12. As illustrated in FIG. 1, this embodiment of the game has five scoring dice 13, 14, 15, 16, and 17; however, any number of scoring dice 12 may be used. In the method of the present invention, master die 11 and scoring dice 12 are used in combination to determine a player's score. As illustrated in FIG. 1, the kit may also include a container for the dice 11 and 12. In one embodiment, the container has a base B and a top T, which mate with each other to retain the dice 11 and 12 therein for packaging, storage, travel, etc. The master die 11 and scoring dice 12 may be retained in especially formed cavities C1 and C2 in the base B, and the base B may also include a scoring member or peg M and member holding grid G, for use in keeping score during a player's turn. The base B may also retain a marker P (e.g., a pencil) and the top T may have a surface S for retaining a score sheet or pad for using in keeping score during play of the game.

Figure 2B:
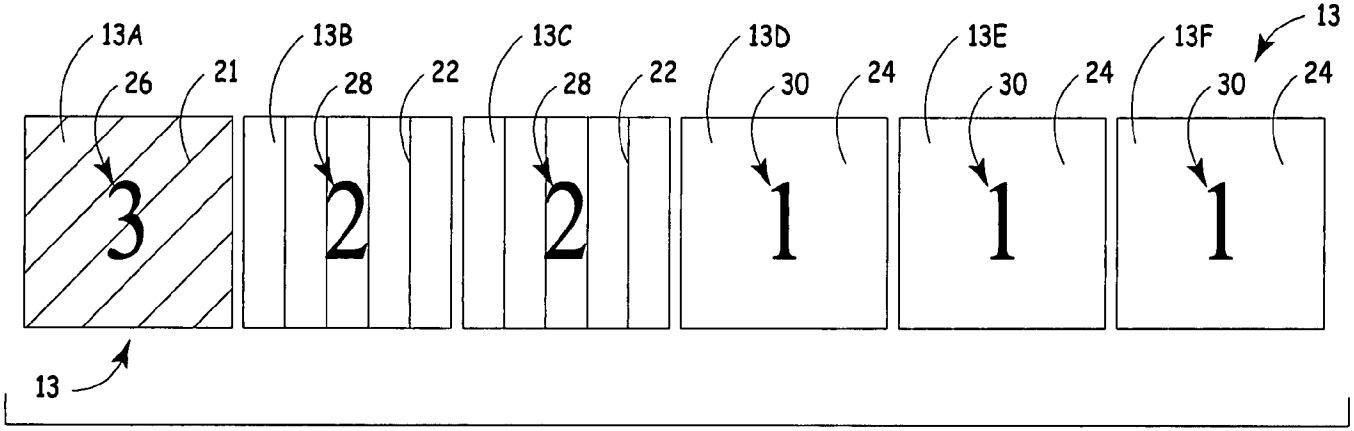
FIG. 2B is a generated view of each of the six sides and accompanying indicia of a scoring die of a first embodiment.
Figure 2A:
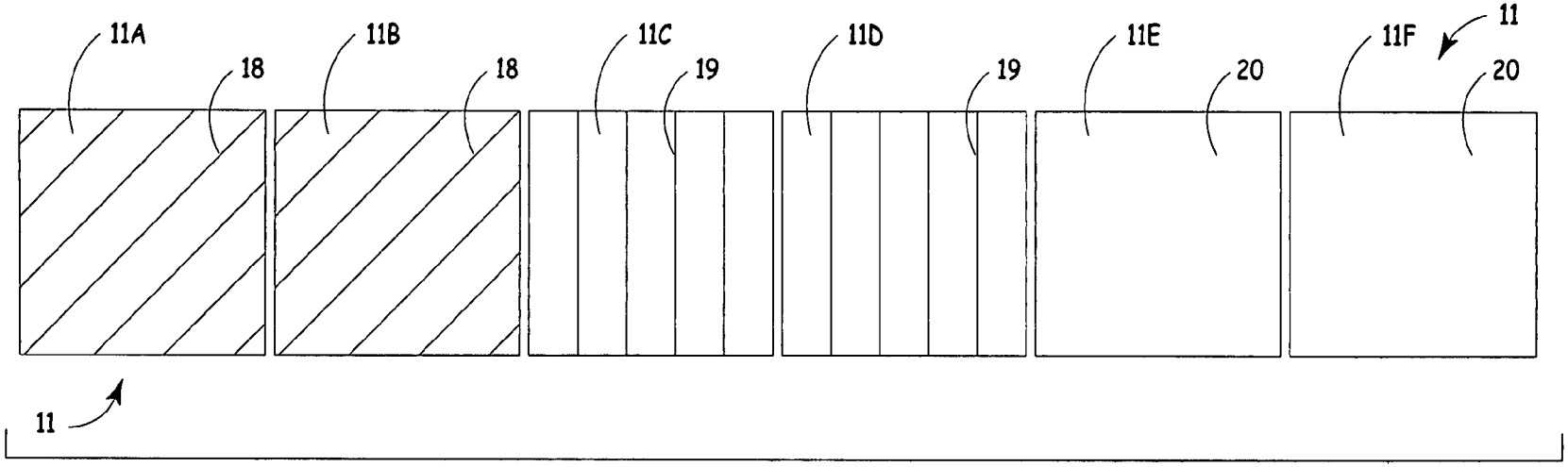
FIG. 2A is a generated view of each of the six sides and accompanying indicia of a master die of a first embodiment.

FIG. 2A is a generated view of a first embodiment of master die 11. In this embodiment, master die 11 has six master sides, shown as sides 11A-11F, and three indicia or master value designations 18, 19, and 20. As illustrated in FIG. 2A, master value designations 18, 19, and 20 are each borne on two of the six master sides 11A-11F. Master value designation 18 is borne on master sides 11A and 11B, master value designation 19 is borne on master sides 11C and 11D, and master value designation 20 is borne on master sides 11E and 11F. In this embodiment, master value designations 18, 19, and 20 are in the form of different colors (e.g., red, blue, and white). In further embodiments, master value designations 18, 19, and 20 can be represented as numbers, patterns, letters, or the like, and/or combinations thereof. FIG. 2A shows master die 11 having six master sides; however, a master die having any number of master sides may be used. In one embodiment, when X number of master sides is used, the number of master value designations is half the number of total master sides. Each master value designation is borne on two of the X master sides. In a further embodiment, master die 11 is visually distinguishable, through size, color, and/or the number of sides, or the like, from each of the scoring dice 12.

FIG. 2B shows a generated view of the first embodiment of die 13 of the plurality of scoring dice 12 illustrated in FIG. 1. In one embodiment, each scoring die 13, 14, 15, 16, and 17 of FIG. 1 is identical. As illustrated in FIG. 2B, scoring die 13 has six scoring sides 13A-13F, and six score value designations 21, 22, 24, 26, 28, and 30. As illustrated, each scoring side 13A-13F contains indicia such as two score value designation 21, 22, 24, 26, 28, and 30: scoring side 13A bears score value designations 21 and 26; scoring sides 13B and 13C bear score value designations 22 and 28; scoring sides 13D, 13E, and 13F bear score value designations 24 and 30. In this embodiment, score value designations 21, 22, and 24 correspond to master die 11 such that, score value designation 21 is equivalent to master value designation 18, score value designation 22 is equivalent to master value designation 19, and score value designation 24 is equivalent to master value designation 20. Further in this embodiment, score value designations 26, 28, and 30 are in the form of the numbers one, two, and three, respectively, as illustrated.

In this embodiment, score value designations 21, 22, and 24 are in the form of different colors; however, as noted above with respect to master value designations 18, 19, and 20 of master die 11, other forms of indicia may be used, such as, for example, numbers, patterns, letters, etc., and/or combinations thereof. Additionally, FIG. 2B shows die 13 of the plurality of scoring dice 12 having six scoring sides; however in other embodiments each scoring die 12 may have any number of scoring sides. The number of sides on each scoring die 12 does not necessarily have to be the same number of sides on master die 11.

Figure 3B:
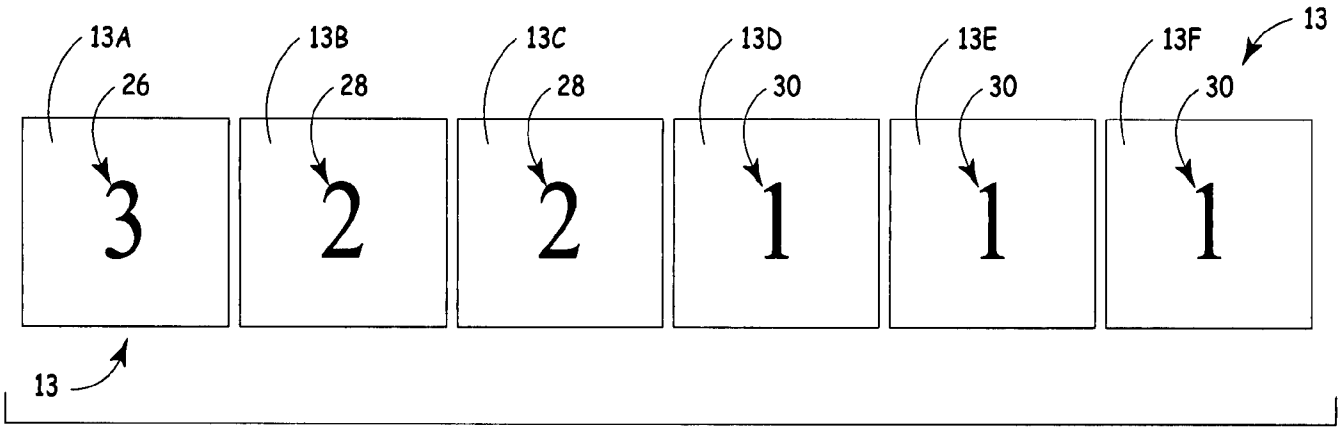
FIG. 3B is a generated view of each of the six sides and accompanying indicia of a scoring die of a second embodiment.
Figure 3A:
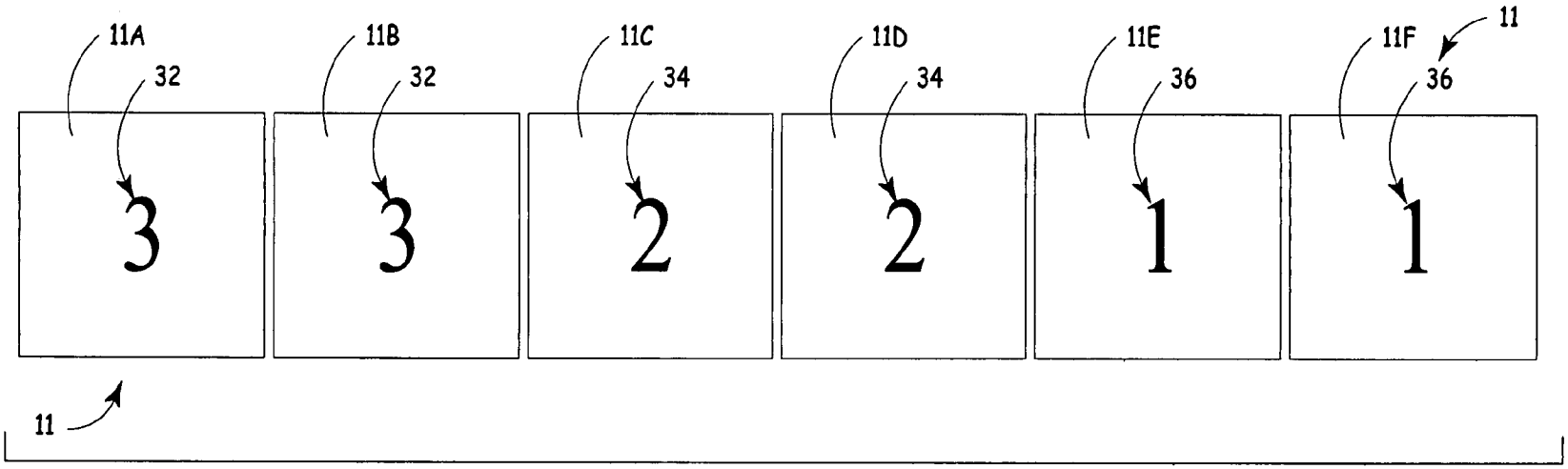
FIG. 3A is a generated view of each of the six sides and accompanying indicia of a master die of a second embodiment.

FIG. 3A shows a generated view of a second embodiment of a six-sided master die 11 where each master side 11A-11F bears one master value designation 32, 34, and 36. As illustrated, each master value designation is borne on two of the six master sides of master die 11.

FIG. 3B shows a generated view of scoring sides 13A-13F of die 13 of the plurality of scoring dice 12 corresponding to master die 11 of FIG. 3A. As illustrated, score value designation 26 is borne on scoring side 13A, score value designation 28 is borne on scoring sides 13B and 13C, and score value designation 30 is borne on scoring sides 13D, 13E, and 13F. Score value designation 26 corresponds to master value designation 32. Score value designation 28 corresponds to master value designation 34. Score value designation 30 corresponds to master value designation 36.

Figure 4B:
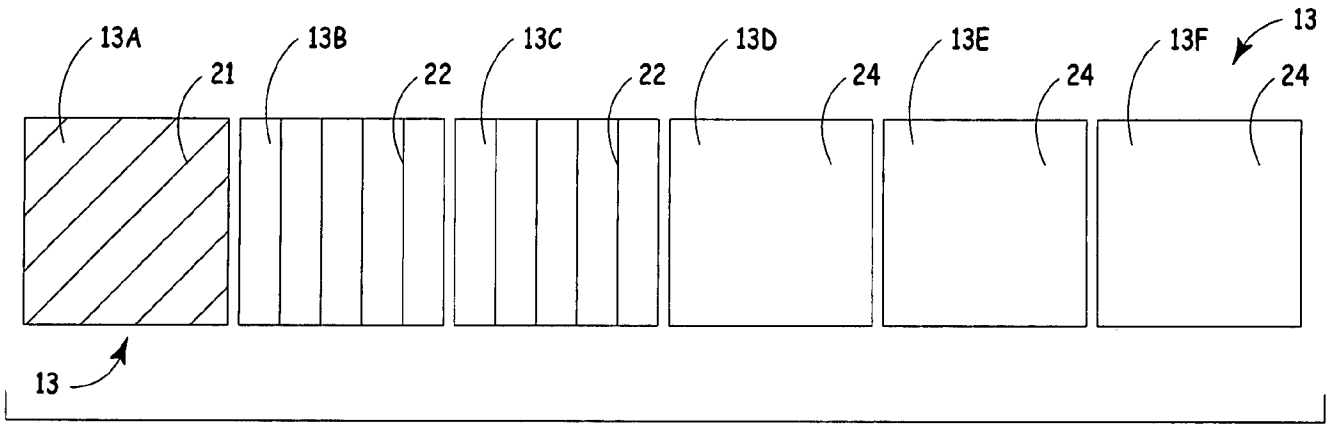
FIG. 4B is a generated view of each of the six sides and accompanying indicia of a scoring die of a third embodiment.
Figure 4A:
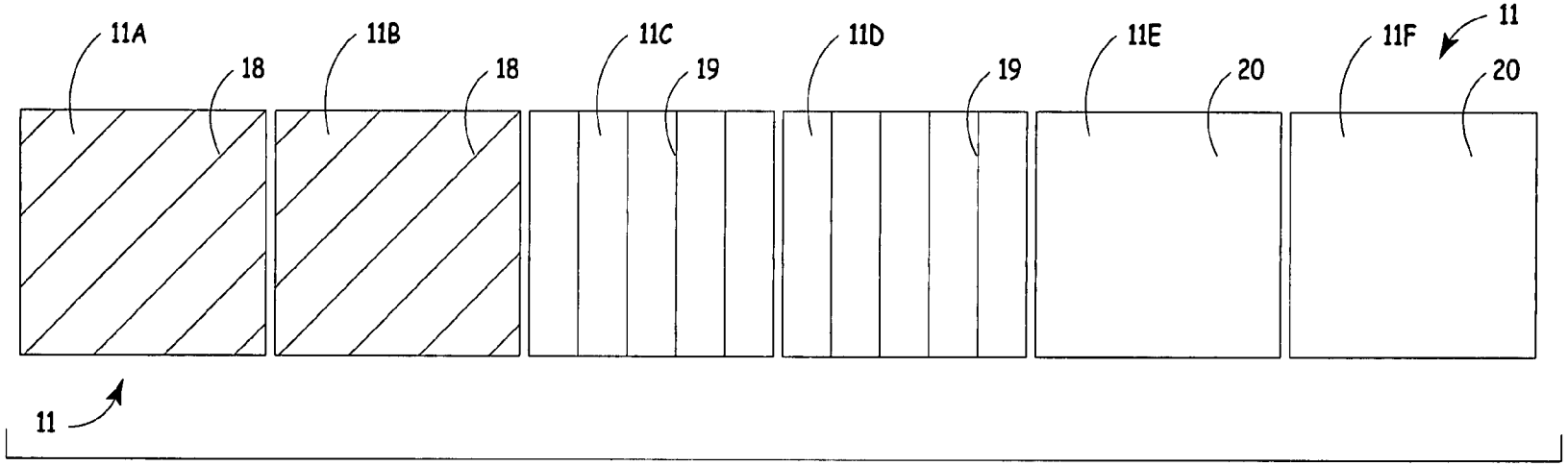
FIG. 4A is a generated view of each of the six sides and accompanying indicia of a master die of a third embodiment.

FIG. 4A shows a generated view of a third embodiment of a six-sided master die 11 where each of master sides 11A-11F bears one of master value designations 18, 19, and 20. As illustrated, each master value designation is borne on two of the six master sides of master die 11.

FIG. 4B shows a generated view of scoring sides 13A-13F of die 13 of the plurality of scoring dice 12 corresponding to master die 11 of FIG. 4A. As illustrated, score value designation 21 is borne on scoring side 13A, score value designation 22 is borne on scoring sides 13B and 13C, and score value designation 24 is borne on scoring sides 13D, 13E, and 13F. Score value designation 21 corresponds to master value designation 18. Score value designation 22 corresponds to master value designation 19. Score value designation 24 corresponds to master value designation 20.

Figure 5:
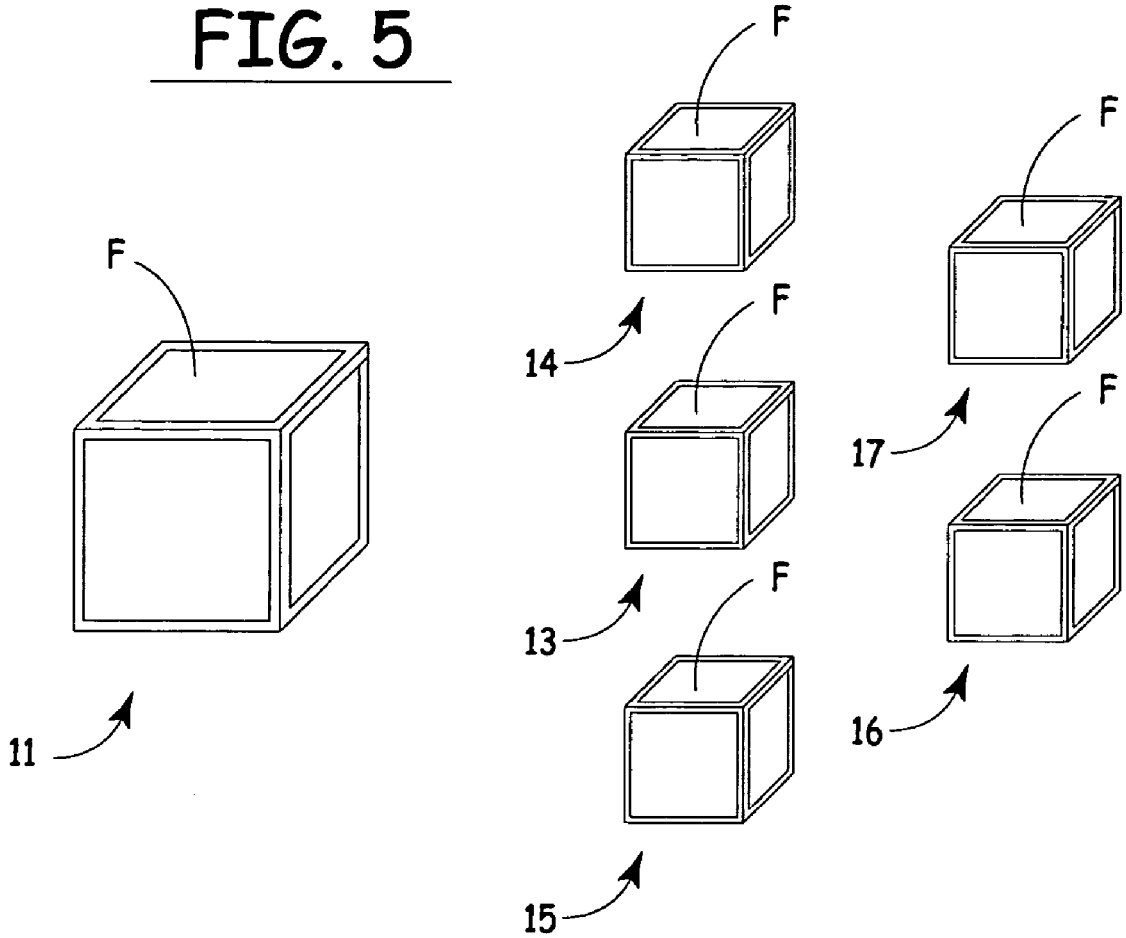
FIG. 5 is a perspective view of a kit of parts used for playing a game of the current invention.

In the first embodiment of the game, the relationship between master die 11 and scoring dice 12 is very important. The first embodiment is played by a plurality of players, and the object of the game is for a player to score more points than any of the opposing players. In this disclosure, a roll, or throw, of all the dice 11, 13, 14, 15, 16, and 17 by a player is called a "shake". A player's turn begins by shaking all scoring dice 13, 14, 15, 16, and 17 and master die 11. FIG. 5 shows all the dice 11, 13, 14, 15, 16, and 17, and their respective upwardly facing sides F after a shake. As is typical with dice games, the upwardly facing side F of each die is the one used for scoring purposes. Points are scored when the indicia on the upwardly facing side F of at least one scoring die 13, 14, 15, 16, and 17 corresponds to the indicia on the upwardly facing side F of master die 11. The game is played by each player alternating turns until the score of one of the players reaches a predetermined winning score, such as fifty or one hundred points.

In each player's turn of the game, that player may take as many shakes of the dice 11, 13, 14, 15, 16, and 17 as desired. To begin a turn, the player shakes all scoring dice 13, 14, 15, 16, and 17 and master die 11. After each shake, a player's score for that shake is calculated based on the number of scoring dice 13, 14, 15, 16, and 17 that have upwardly facing sides F that correspond to master die 11. This score is called a player's shake score. The score in the method of the invention may represent an arbitrary point value, a simulated monetary value, or a real monetary value throughout the various embodiments.

Figure 6:
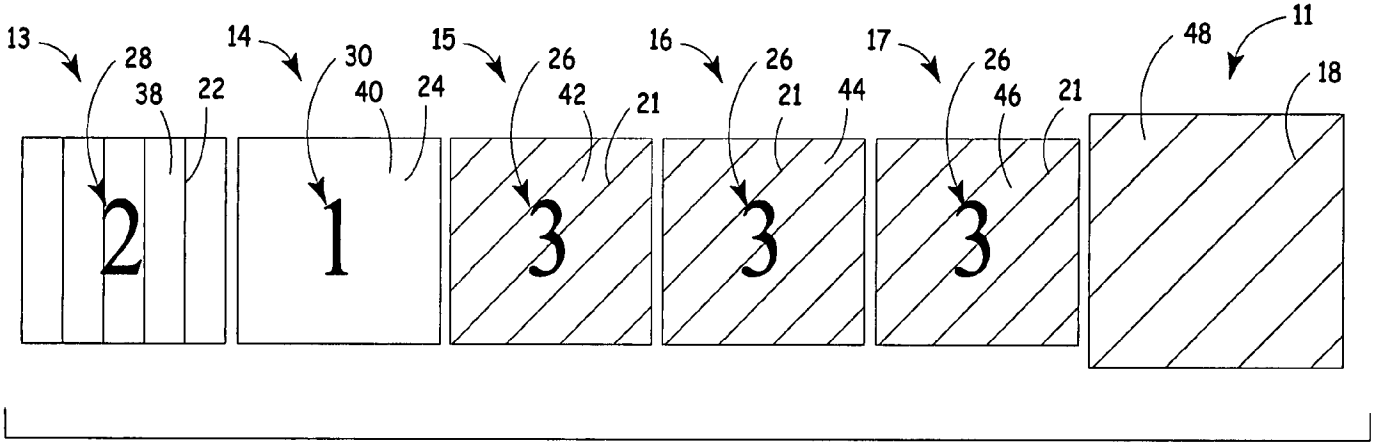
FIG. 6 is an illustration of the results of a shake with a non-zero point value.

FIG. 6 shows an example of the results of a player's shake. The upwardly facing scoring side 38, 40, 42, 44, and 46 of each scoring die 13, 14, 15, 16, and 17, respectively, is shown. The upwardly facing master side 48 of master die 11 is also shown. To calculate the shake score for a player, the upwardly facing scoring sides 38, 40, 42, 44, and 46 of each scoring die 13, 14, 15, 16, and 17 is compared to the upwardly facing master side 48 of master die 11. In this embodiment, score value designations 21, 22, and 24 are compared to master value designation 18. Points are awarded for the number of sides between master die 11 and scoring die 13, 14, 15, 16, and 17 which have corresponding value designations.

As illustrated in FIG. 6, upwardly facing scoring side 42 of scoring die 15, upwardly facing scoring side 44 of scoring die 16, and upwardly facing scoring side 46 of scoring die 17 each bear score value designation 21. As also illustrated in FIG. 6, master die 11 bears master value designation 18. As previously discussed, score value designation 21 corresponds to master value designation 18. Therefore, the player will score points for this shake for scoring die 15, scoring die 16, and scoring die 17.

In FIG. 6, upwardly facing scoring sides 42, 44, and 46 of scoring die 15, 16, and 17, respectively, also bear score value designation 26. As illustrated, score value designation 26 is represented as the number three (3). In this embodiment of the game, points are awarded according to the score value designation 26 borne on the same upwardly facing scoring sides 42, 44, and 46 which correspond to master value designation 18 on upwardly facing master side 48 of master die 11. Therefore, this shake would earn the player three (3) points for each upwardly facing scoring side 42, 44, and 46 of scoring dice 15, 16, and 17, for a shake score of nine (9) points (3 points+3 points+3 points=9 points).

Figure 7:
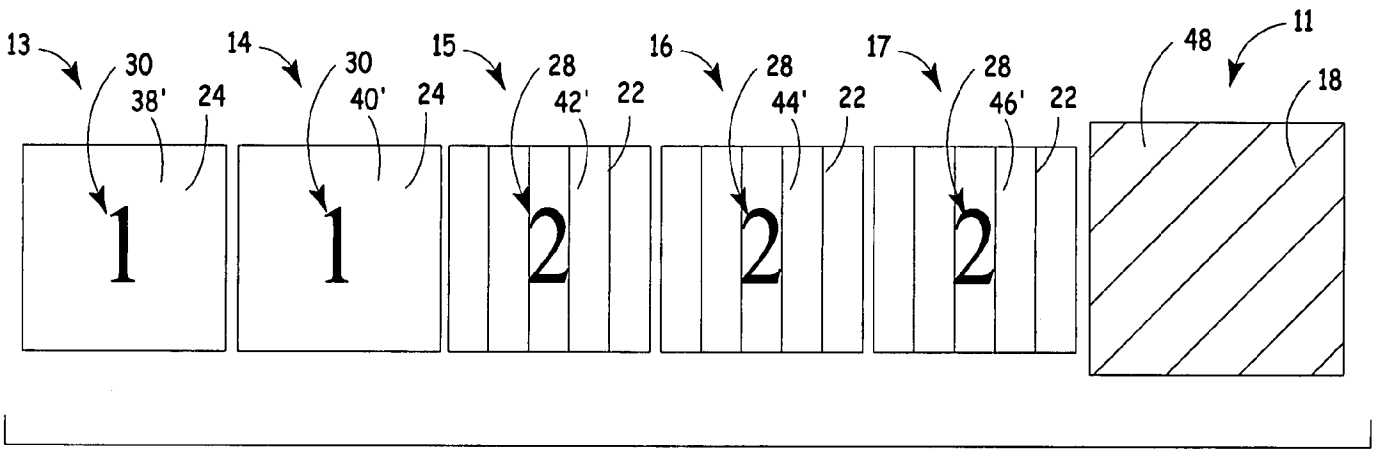
FIG. 7 is an illustration of the results of a shake with a zero point value.

FIG. 7 shows another example of the results of a player's shake. The upwardly facing scoring side 38', 40', 42', 44', and 46' of each scoring die 13, 14, 15, 16, and 17, respectively, is shown. The upwardly facing master side 48 of master die 11 is also shown. As illustrated, when master value designation 18 on upwardly facing master side 48 is compared to score value designations 22 and 24 on upwardly facing scoring sides 38', 40', 42', 44', and 46' it can be seen that none are equivalent (i.e., none of the indicia, such as color, on any of upwardly facing scoring sides 38', 40', 42', 44', and 46' of scoring dice 13, 14, 15, 16, and 17 for this shake match the indicia, such as color, on upwardly facing master side 48 of master die 11). Therefore, the player would not earn points from any of scoring dice 13, 14, 15, 16, and 17 from this shake. This is considered a shake of zero-value. In the inventive game, having a shake of zero-value is called being "blanked".

Figure 8:
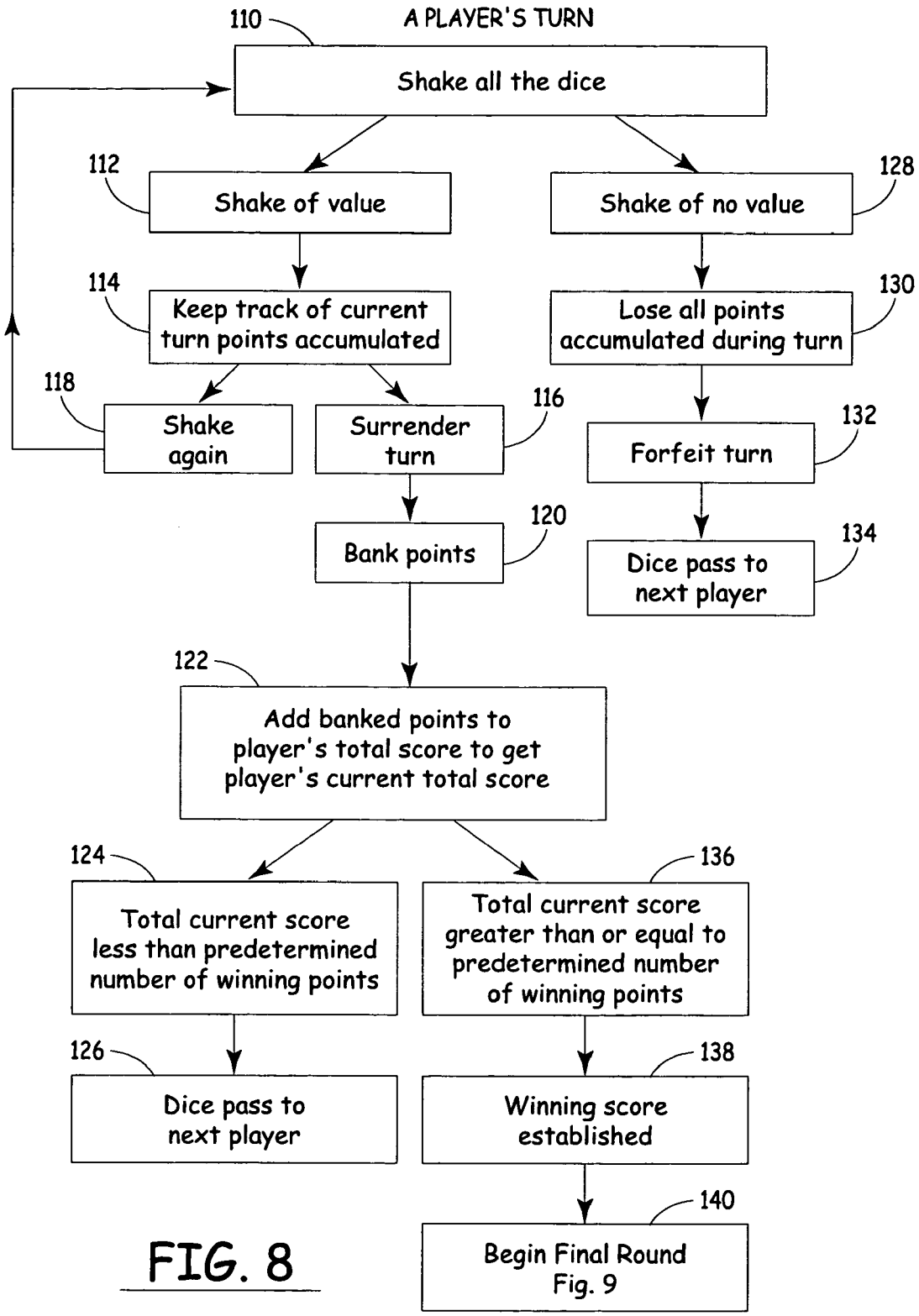
FIG. 8 is a block diagram of a player's turn in one embodiment of the method of playing the game of the current invention.

FIG. 8 is a block diagram of one embodiment of the method of playing a game of the current invention. In this embodiment of the game, a plurality of players compete to achieve a winning number of points. The method of this embodiment creates a game of risk, in that, a player must decide between (1) ending the player's turn, and keeping the player's score, or (2) continuing the player's turn to increase the player's score while risking loss of all the points accumulated during that turn. By continuing a turn, the player is betting the turn score on the hope that the next shake is to have a value greater than zero. Therefore, this embodiment of the method of the present invention rewards a player for streaks of shakes which have a score greater that zero. The play, points and scoring system will be discussed, with reference made to appropriate game pieces previously discussed.

In this embodiment of the game, play begins with a first player beginning a turn. To begin a turn, the first player shakes 110 master die 11 and scoring dice 12. Any points accumulated following the first player's shake are accumulated according to the method discussed in FIG. 6 and FIG. 7. If the player's shake results in a shake of value 112 (e.g., nine points as exemplified in FIG. 6) the player will keep track of the number of points earned by that shake 114, and has two options: (1) the player can decide to surrender the turn 116; or (2) the player can decide to shake again 118. If the player chooses to shake again 118 the points earned after each shake are added together 114. However, if a player is satisfied with the number of points the player has accumulated during a turn 110, the player may surrender the turn 116 to the next player. A player may chose to surrender his turn 116 after any shake of value 112 (i.e., after any shake that has a value greater than zero). Once a player has surrendered the turn, the points accumulated during that turn, called the turn score, are held, or banked 120, by that player and added to that player's previous turn score to compute that player's current total score 122. Once a player has surrendered the turn 116, the player's current total score 122, or accumulation of banked points, will remain with the player until the conclusion of the game. If the player's total score has not reached a predetermined number of winning points 124, then dice 11, 13, 14, 15, 16, and 17 are moved to the next player 126 to begin a turn.

However, if a player is blanked 128 (i.e., a shake having a value of zero as exemplified in FIG. 7) before the player surrenders the turn 116, then the player loses all the points accumulated during that turn 130 and the player's turn is forfeited 132. Once a player is blanked 128, the dice 11, 13, 14, 15, 16, and 17 are moved to the next player 134 to begin a turn. The player who has been blanked 128 does not bank any points from that turn and the player's current total score remains the same as the player's total score at the conclusion of that player's previous turn.

Players continue to alternate turns until one player's current turn score when added to the player's current total score is greater than, or equal to, a predetermined number of winning points 136 (e.g., a winning score of 50 or 100 points). At this time in the player's turn, the player has the same two options: (1) the player can choose to surrender the turn 116 and bank the points accumulated during that turn 120, establish a winning score 138, and possibly win the game, subject to being exceeded by the other players during a final round 140; or (2) the player can choose to continue the turn by shaking again 118 to possibly increase the final score, in effect, making it more difficult for the other players to surpass the player's current total score and win the game. If the player chooses to continue the turn 118, however, and is blanked 128 during that turn, the player loses all the points accumulated during that turn 130 and the turn is forfeited 132. The predetermined winning score 138 would, therefore, not be established for that player's turn.

Figure 9:
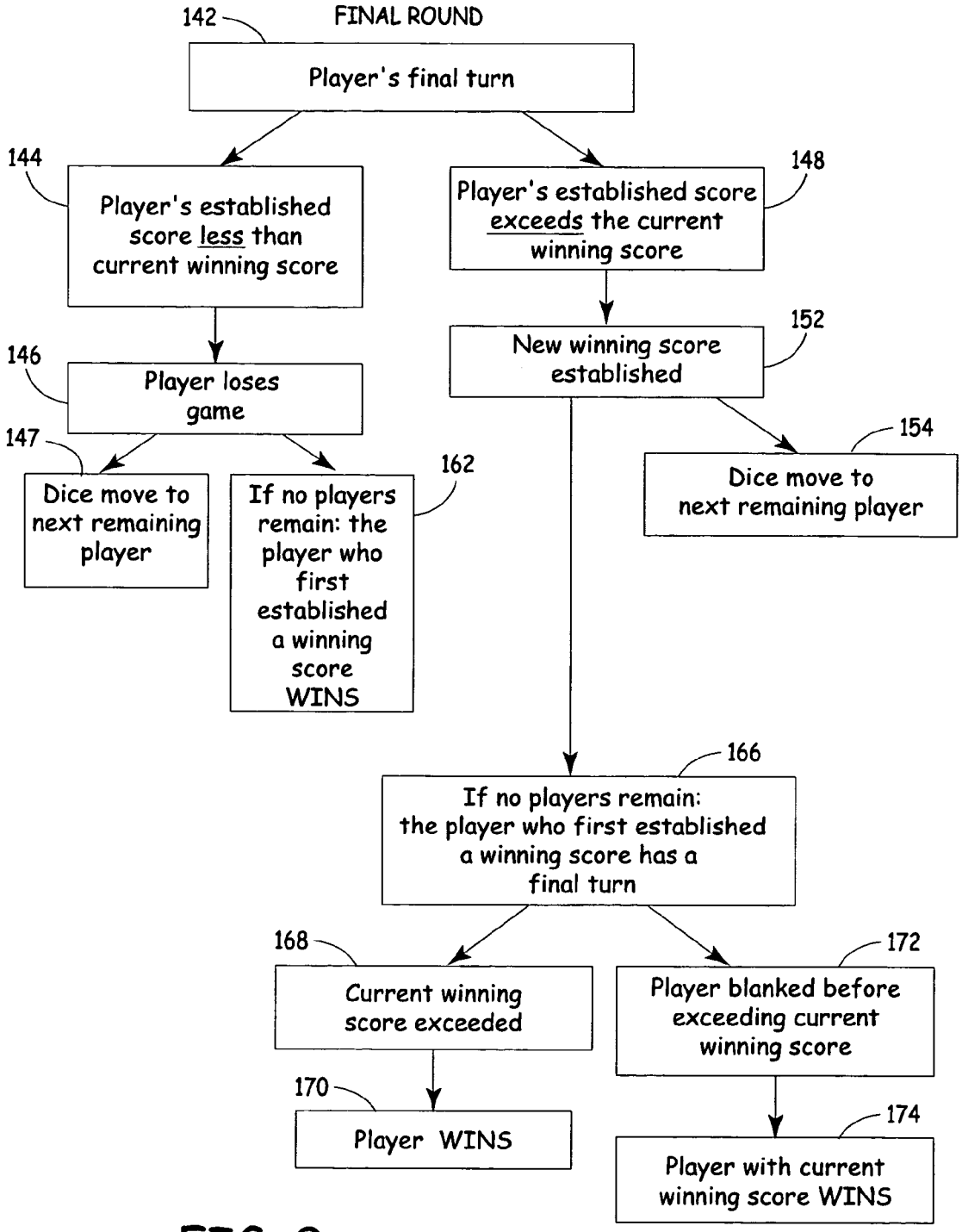
FIG. 9 is a block diagram of the final round of the method of playing the game of the current invention.

In this embodiment, the predetermined winning score is fifty (50) points. When a player's total score of at least fifty (50) points is established 138, the final round begins and each player is allowed one final turn. FIG. 9 is a block diagram of the final round of the game. During the final round turn a player is faced with the same two decisions: (1) to surrender the turn, establish a winning score and possibly win the game; or (2) to continue the turn by shaking again to increase the final score making it more difficult for the remaining players while risking losing all the points accumulated during the turn if the player is blanked.

If, during this final turn 142, a player does not accumulate enough points to exceed the winning score 144, or the player is blanked before surrendering the turn, that player loses the game 146, and the dice pass to the next remaining player 147.

If, however, following a player's final turn 142, the player's established score exceeds the current winning score 148, that player establishes a new winning score 152 and is the current winner.

Following the final round, if no player is able to exceed the original winning score 138, the original player to establish a winning score 138 wins the game 162. However, if a new winning score has been established 152' the player who first established the winning score 138 will then get one last turn 166. If that player is able to exceed 168 the current winning score 152 and surrenders that player's turn before getting blanked, that player wins the game 170. If that player is blanked before exceeding 172 the current winning score 152, the player with the current winning score 152 wins the game 174.

Also in this embodiment, if two or more players exceed fifty (50) points and have identical scores, all of the players, not just the players who have tied, get one more turn during a tie-break round. The player with the highest score at the end of this final round wins.

Another embodiment of the game can be played with one player. In this embodiment, the player successively shakes dice 11, 13, 14, 15, 16, and 17. The player accumulates points based on the outcome of each successive shake according to the previously discussed scoring system. The points that player accumulates after each shake in the turn are summed together. The object of the game is to accumulate the most points during a turn before that player is blanked. Once being blanked, the player begins a new turn and attempts to score higher than the previous turn.

The present invention provides a method of playing a game of chance and entertainment. The game has a plurality of playing pieces, including both a master die and a plurality of scoring dice. In playing a game according to this method, the playing pieces are shaken. During play, all of the playing pieces are thrown during every shake. Each shake results in a score value for that player. Upon completion of a player's turn, the player's score is determined by adding up the points of each shake. Points are awarded based on the corresponding upwardly facing scoring sides and master side, according to a predetermined scoring system. If during a player's turn none of the scoring dice correspond to the master die, the player forfeits the turn and loses all the points accumulated during that turn. Accordingly, the scoring system of the present embodiment rewards a player for having streaks of shakes with value. During each turn, the player may risk all the points the player has accumulated during that turn on the belief that the player will continue the streak and continue to increase the turn score.

In the foregoing description of the method of the present invention, the invention has been described with reference to an embodiment which uses a kit of parts containing real, physical dice. However, the method of playing a game according to the present invention in all embodiments disclosed above and their equivalents may be played in a casino with a live dealer using for example, dice or a special set of playing cards, on a video gaming machine, with software on a personal or handheld computer, or with any other machine (e.g., PDA, cell phone, etc.) capable of simulating dice or any other mechanism capable of generating a plurality of random value designations.

In such "virtual" versions of the game, one embodiment involves one or more players competing using a designated playing system. Rather than an upwardly facing master side (see, e.g., F in FIG. 5) of a physical master die 11, a selected random master value designation is generated on a master indicator. A player begins a turn, by causing or "shaking" the playing system to generate one master value designation from a group of master value designations and at least one score value designation from a group of score value designations. A player's score for that turn is obtained according to a scoring system. The player earns points for each score value designation which corresponds to the master value designation. If no score value designations correspond to the master value designation, the player loses the turn, and the player's score for that turn is zero. The correspondence may be based on matching indicia, or any other detectable correspondence between the master and score value designations.

Once a turn is begun, the player continues to shake until the player surrenders that turn, or the player has a shake of zero-value. After a shake of zero-value the player's turn is forfeited and the player's turn score is zero. The method of the present invention creates a game of risk, such that, a player must decide between (1) ending the turn, and keeping the current turn score, or (2) continuing the turn to increase the turn score while risking loss of all the points accumulated during that turn. By continuing a turn, the player is betting the turn score on the hope that the next shake is to have a value greater than zero. Therefore, the method of the present invention rewards a player for streaks of shakes which have a score greater that zero.

Although the present invention has been described with reference to preferred embodiments, workers skilled in the art will recognize that changes may be made in form and detail without departing from the spirit and scope of the invention.

The invention claimed is:

1. A method of playing a game comprising:

shaking a master die having a plurality of different master indicia during a player's turn to obtain a master designation from the master die;

shaking a plurality of scoring dice of a first set of scoring dice wherein each scoring die of the first set of scoring dice includes a plurality of score value indicia and the plurality of different master indicia of the master die during the player's turn to obtain a score value and the master designation for each of the plurality of scoring dice;

comparing the master designation for each of the plurality of scoring dice to the master designation on the master die;

identifying a second set of scoring dice including one or more of the scoring die where the indicia of the master designation on the scoring die of the first set of scoring dice is the same as the indicia of the master designation on the master die; and using the score values from the second set of scoring dice to calculate a shake score for use in determining a resolution of the game.

2. The method of claim 1 wherein using the score valves from the second set of scoring dice comprises:

identifying at least one of the plurality of scoring dice having the same master designation as the master die; and calculating a non zero value shake score based upon the at least one of the plurality of scoring dice having the same master designation as the master designation of the master die.

3. The method of claim 1 wherein none of the master designations on the plurality of scoring dice of the first set of scoring dice matches the master designation of the master die and using the score values from the second set of scoring dice comprises:

calculating a zero value shake score.

4. The method of claim 3 and further comprising: forfeiting the player's turn based upon the zero value shake score.

5. The method of claim 1 and further comprising:

repeating the steps of shaking the master die and shaking the plurality of scoring dice;

repeating the steps of comparing of the master designation for each of the plurality of scoring dice of the first set of scoring dice to the master designation on the master die, identifying the second set of scoring dice including one or more of the scoring dice of the first set of scoring dice having the same master designation as the master die and using the score values from the second set of scoring dice to calculate the shake score; and totaling the shake score with one or more previous shakes scores to obtain a cumulative shake score for the player's turn for use in determining the resolution of the game.

6. The method of claim 5 wherein if none of the master designations of the plurality of scoring dice of the first set of scoring dice matches the master designation of the master die, the step of totaling the shake score includes:

calculating a zero value cumulative score.

7. The method of claim 6 and further comprising:

forfeiting the player's turn following the step of repeating the steps of shaking the master die and shaking the plurality of scoring dice if none of the master designations of the plurality of scoring dice of the first set of scoring dice matches the master designation of the master die.

8. The method of claim 5 wherein the step of shaking the master die and shaking the plurality of scoring dice is repeated based upon a player's choice and if none of the master designations of the plurality of scoring dice of the first set of scoring dice matches the master designation on the master die, the player is blanked.

9. The method of claim 1 and comprising following using the score values from the second set of scoring dice to calculate the shake score:

totaling one or more shake scores to obtain a cumulative shake score for the player's turn; and surrendering the player's turn to another player to repeat the steps of shaking the master die and shaking the plurality of scoring dice.

10. The method of claim 1 wherein the game is played by multiple players and further comprising:

repeating the steps of shaking the master die and shaking the plurality of scoring dice for one or more additional players during one or more additional players' turns;

comparing the master designation for each of the plurality of scoring dice of the first set of scoring dice to the master designation on the master die for the repeated steps of shaking the master die and shaking the plurality of scoring dice;

identifying the second set of scoring dice that have the same master designation as the master designation on the master die for the repeated steps of shaking the master die and shaking the plurality of scoring dice; and using the score values from the second set of scoring dice to calculate the shake scores for each of the repeat steps for the one or more additional players.

11. The method of claim 10 and further comprising:

calculating a zero value shake score for the one or more additional players' turns if the master designation on the master die does not match the master designation on any of the plurality of scoring dice of the first set of scoring dice; and transferring the one or more additional player's turn to another player to repeat the steps of shaking the master die and shaking the plurality of scoring dice.

12. The method of claim 10, and further comprising:

allowing any player who has a cumulative shake score equal to or greater than a winning score for the game to surrender their turn to another player; and establishing the cumulative shake score for that player as a new winning score for the game.

13. The method of claim 10 and in a final round comprising:

allowing each one of the multiple players a final turn;

totaling one or more of the shake scores to determine a final cumulative shake score for each of the multiple players; and determining a winning player based upon the player with the final cumulative shake score that is higher than the final cumulative shake score of the other players.

14. The method of claim 1 and further comprising:

calculating the shake score based upon a point value system for each of the plurality of score value indicia.

15. The method of claim 1 wherein the plurality of different master indicia are the same as the plurality of score value indicia.

16. A method which when implemented by a computer performs the steps of:

shaking a master die having a plurality of different master indicia during a player's turn to obtain a master designation from the master die;

shaking a plurality of scoring dice of a first set of scoring dice each of the scoring die of the first set of scoring dice including a plurality of score value indicia and the plurality of different master indicia of the master die during the player's turn to obtain a score value and the master designation for the plurality of scoring dice;

comparing the master designation for each of the plurality of scoring dice to the master designation on the master die;

identifying a second set of scoring dice including one or more of the scoring dice where the indicia of the master designation on the scoring dice of the first set of scoring dice is the same as the indicia of the master designation on the master die;

using the score values of the second set of scoring dice to calculate a shake score for use in determining a resolution of a game.

17. The method of claim 16 wherein the plurality of different master indicia includes first, second and third master indicia; and comprising designating at least three of the first master indicia, at least two of the second master indicia and one of the third master indicia on each of the plurality of scoring dice.

18. The method of claim 16, and further comprising:

designating one of a first, second, and third master indicia on the master die;

designating the score value indicia on each of the plurality of scoring dice such that each of the plurality of scoring dice includes a first score value indicia corresponding to the first master indicia;

two of a second score value indicia corresponding to the second master indicia; and one of a third score value indicia corresponding to the third master indicia.

19. The method of claim 16 wherein using the score values of the second set of scoring dice to calculate the shake score comprises:

assigning a point value to each of the plurality of score value indicia on the plurality of scoring dice; and calculating the shake score based upon the assigned point value for the score values of the second set of scoring dice.

20. The method of claim 16 wherein the master indicia on the plurality of scoring dice is the same as the plurality of score value indicia.

21. The method of claim 16 and further comprising:

repeating the steps of shaking the master die and shaking the plurality of scoring dice; and determining a cumulative shake score for the player's turn by totaling the shake scores for each step of shaking the master die and shaking the plurality of scoring dice.

22. The method of claim 16 comprising:

repeating the steps of shaking the master die and shaking the plurality of scoring dice during multiple players' turns;

comparing the master designation of the plurality scoring dice of the first set of scoring dice to the master designation on the master die;

identifying a second set of scoring dice including one or more of the scoring dice of the first set of scoring dice that have the same master designation as the master designation of the master die; and using the score values of the second set of scoring dice to calculate the shake score based upon the score values for the multiple players' turns.

23. The method of claim 16 comprising:

calculating a zero value shake score if none of the master designation on the plurality of scoring dice of the first set of scoring dice match the master designation of the master die; and forfeiting the player's turn.

24. The method of claim 16 wherein the plurality of score value indicia for the plurality of scoring dice have a score value based upon frequency of the plurality of different master indicia on the plurality of scoring dice.

25. The method of claim 16 wherein the plurality of different master indicia includes at least three different master indicia.

* * * * *